US008146280B2

(12) United States Patent
Mehler

(10) Patent No.: US 8,146,280 B2
(45) Date of Patent: Apr. 3, 2012

(54) DECORATIVE FRAME ASSEMBLY AND METHOD

(76) Inventor: Anne Suzette Mehler, Long Beach, CA (US)

( * ) Notice: Subject to any disclaimer, the term of this patent is extended or adjusted under 35 U.S.C. 154(b) by 0 days.

(21) Appl. No.: 11/719,232

(22) PCT Filed: May 11, 2007

(86) PCT No.: PCT/US2007/068753

§ 371 (c)(1),
(2), (4) Date: May 14, 2007

(87) PCT Pub. No.: WO2007/134221

PCT Pub. Date: Nov. 22, 2007

(65) Prior Publication Data

US 2009/0229157 A1 Sep. 17, 2009

Related U.S. Application Data

(60) Provisional application No. 60/747,230, filed on May 15, 2006.

(51) Int. Cl.
*A47G 1/06* (2006.01)

(52) U.S. Cl. ..... 40/786; 40/765; 40/788; 40/789

(58) Field of Classification Search ..... 40/799, 40/754, 761, 760, 753, 124.08, 124.14, 124.16, 40/124.19, 709, 724, 750, 774, 780–782, 40/786, 788, 789
See application file for complete search history.

(56) References Cited

U.S. PATENT DOCUMENTS

| | | | | |
|---|---|---|---|---|
| 1,589,948 | A | | 6/1926 | Degginger |
| 1,940,328 | A | | 12/1933 | Schrotenboer |
| 2,245,363 | A | * | 6/1941 | Price ..... 40/753 |
| 2,660,825 | A | * | 12/1953 | Howard ..... 40/789 |
| 2,806,310 | A | * | 9/1957 | Boyd ..... 40/789 |
| 3,408,759 | A | * | 11/1968 | Rotheraine et al. ..... 40/732 |
| 3,548,527 | A | * | 12/1970 | Acosto et al. ..... 40/754 |
| 3,757,445 | A | * | 9/1973 | Stilwell ..... 40/788 |
| 4,033,060 | A | | 7/1977 | Lawrence |
| 4,357,769 | A | | 11/1982 | Leahy |
| 4,825,572 | A | | 5/1989 | Altman Robbins et al. |
| 5,003,715 | A | * | 4/1991 | Steiner ..... 40/442 |
| 5,077,921 | A | | 1/1992 | Mooney |
| 5,383,293 | A | * | 1/1995 | Royal ..... 40/768 |
| 5,400,532 | A | * | 3/1995 | Grove ..... 40/721 |
| 5,475,938 | A | | 12/1995 | Bergan |

(Continued)

FOREIGN PATENT DOCUMENTS

| | | |
|---|---|---|
| BE | 461443 | 11/1945 |
| CH | 247407 | 3/1947 |
| FR | 923958 | 2/1947 |

OTHER PUBLICATIONS

PCTUS07068753 International Search Report and Written Opinion, May 14, 2008.

(Continued)

*Primary Examiner* — Joanne Silbermann
*Assistant Examiner* — Shin Kim
(74) *Attorney, Agent, or Firm* — Cook Alex Ltd.

(57) ABSTRACT

A decorative frame assembly is provided. The frame assembly incorporates mechanically reproduced decorative components onto outwardly facing surfaces in order to provide an inexpensive mimic of a conventional frame. A method of assembly also is provided. A typical frame assembly includes a photographically reproduced decorative element.

22 Claims, 7 Drawing Sheets

U.S. PATENT DOCUMENTS

| | | | | |
|---|---|---|---|---|
| 5,783,005 | A | 7/1998 | Handler | |
| 5,936,862 | A | 8/1999 | Wong | |
| 6,105,228 | A * | 8/2000 | Ishii | 29/33 J |
| 6,962,017 | B1 * | 11/2005 | Pounds | 40/781 |
| 2002/0133996 | A1 | 9/2002 | Driscoll | |
| 2005/0183308 | A1 * | 8/2005 | Peery | 40/788 |

OTHER PUBLICATIONS

PCT/US2007/068753—International Preliminary Report on Patentability (Chapter I), of Nov. 27, 2008.

EnglishGerman version of Swiss 247,407, Oct. 28, 2008, Konni.

* cited by examiner 11
12
13
14
15
16
17
18
19
21
22
23
23a
24
25
4

71
72
73
73a
74
75
70
81
82
83
84
85
86
87
88

DECORATIVE FRAME ASSEMBLY AND METHOD

CROSS REFERENCE TO RELATED APPLICATIONS

Priority is claimed from U.S. Provisional Patent Application Ser. No. 60/747,230, filed May 15, 2006, and from PCT Application Serial No. PCT/US07/68753, filed May 11, 2007, hereby incorporated by reference hereinto.

FIELD OF THE INVENTION

This invention generally relates to decorative frame assemblies that are suitable for displaying and enhancing the appearance of items that are desired to be framed. Also included are methods of assembly. More particularly, this invention relates to frame assemblies and methods wherein the frame itself is decorated by including an ornamental substrate.

DESCRIPTION OF RELATED ART

Framing devices that are of inexpensive materials are generally known in the art. Examples include Handler U.S. Pat. No. 5,783,005 which proposes an approach by which a decorative member such as a work of art is cut to provide a center section and a separate perimeter section, thereby breaking the image so that a respective portion of the broken image is displayed in the center section and in the separate perimeter section, while interposing an intermediate border therebetween. This provides a complete picture product rather than a decorative frame that is usable for a variety of different items to be displayed.

Schrotenboer U.S. Pat. No. 1,940,328 describes a box picture frame, while indicating that portions of the frame may be tightly wrapped with covering paper identified as a leatherette, gilt or other attractive covering paper. Lawrence U.S. Pat. No. 4,033,060 relates to picture frame construction having an outer frame element, an inner frame element and a picture retaining element so as to provide what is indicated as a lightweight frame construction.

Prior art such as this does not disclose, teach or suggest a new approach that has been introduced by and addressed by the present disclosure. This includes how to provide frame members that are not only inexpensive but also exhibit decorative patterns, for example, in a three-dimensional fashion, and that can be inexpensively prepared by being reproductions of frame patterns or other decorative components that may be considered worthy of reproduction. Also, it can be desirable to provide such decorative frame assemblies in the form of frames that have a three-dimensional and/or beveled character, such as those that project with respect to the item being framed in a manner that accentuates the decorative frame component.

Accordingly, a general embodiment, object or aspect of the present invention is to provide an improved inexpensive frame product and method of making same, which product provides an inexpensive but attractive representation of a desirable frame décor or other indicia.

Another embodiment, object or aspect of this invention is to provide a decorative frame assembly and method of making same that, while inexpensive and lightweight, is of sturdy construction and can be reusable or disposable as desired.

Other embodiments, aspects, objects and advantages of the present invention, including the various features used in various combinations, will be understood from the following description according to certain embodiments of the present invention taken in conjunction with the drawings in which certain specific features are shown.

SUMMARY OF THE INVENTION

In accordance with the present invention, an inexpensive decorative frame assembly is provided that displays any one of a variety of images or indicia chosen according to décor and personal preferences from among a myriad of possible sources of images, indicia patterns, frame designs, outlines, and so forth. Such decorative component is located on a frame face that is part of a frame component, often a frame component that projects with respect to the work of art, photograph or other item for display within the frame device.

A backboard having a component or multiple components for facilitating display on a wall or horizontal surface typically is part of the frame assembly. In some embodiments with a separate front component and backboard component, a spacer component is positioned between the projecting frame and the backboard so as to facilitate positioning of the printout, photo, hand-made work of art, award, or other item to be displayed within the frame assembly.

DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
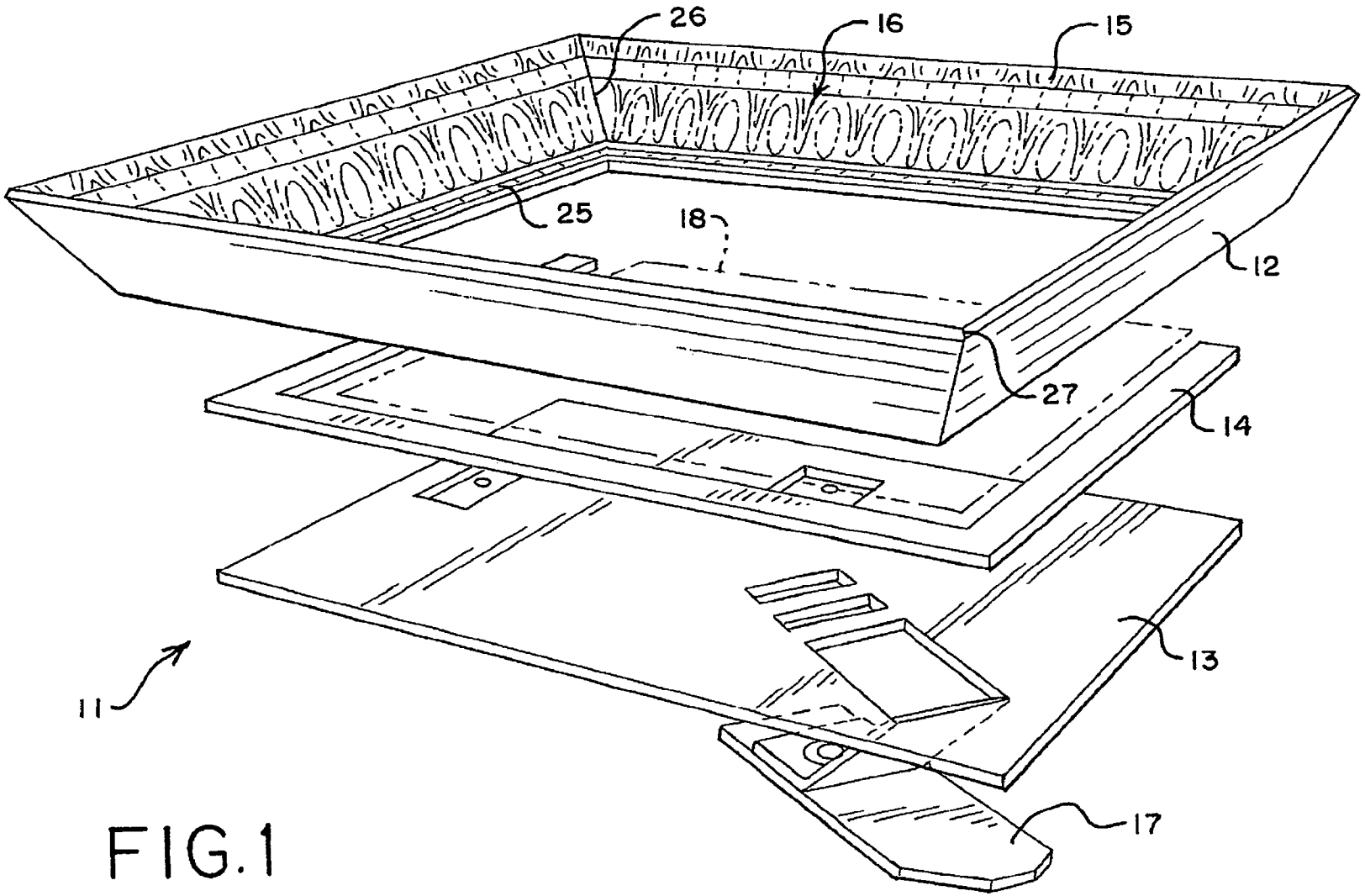
FIG. 1 is an exploded perspective view of an illustrative embodiment of the decorative frame assembly.

An embodiment of an ornamental frame assembly is generally designated 11 in FIG. 1. Frame assembly 11 includes a front component or perimeter frame member 12, a backboard 13 and a spacer 14. These are assembled together by appropriate means such as adhesives, glues, tapes, magnetic components, mechanical components such as clips, brads or staples, or any other suitable means or arrangement. Further details of this embodiment are found in FIGS. 2, 3 and 4.

In an aspect of this embodiment of the invention, the perimeter frame member 12 includes a frame face substrate 15. This frame face substrate faces outwardly and forwardly. This provides decorative aspects to the frame assembly by incorporating images, indicia, designs, decorations, whether complete for display or outlined for optional completion, ornamentation or coloration by a user, or other desirable decorative appearances. Once appearance characteristics that are to be provided by the manufacturer are chosen, they typically are generated by reproduction approaches.

Typical reproduction approaches include photography, often digital photography, which is printed, developed or otherwise presented onto the outside surface of the frame face substrate. Printing technology also is available for this. Silk screen technology also is available for this. Photographic approaches have the advantage of directly reproducing existing or master frame motifs or designs without requiring motif or design creation specific for this purpose. This decorative component is generally illustrated at 16 in the approach of this embodiment. Backboard 13 helps to hold an item to be framed such as a print or photograph in place within the assembly.

It will be appreciated that this and other embodiments display an item to be displayed 18 such as the illustrated print in a pleasing manner. More particularly, the print or other suitable item to be displayed will be surrounded by the decorative aspects that are provided in decorative component 16 of the frame face substrate 15.

With further reference to the embodiment that is illustrated in FIG. 1, the decorative component 16 takes the form of a digital photograph of a gilt gold frame. The digital photograph is printed upon suitable substrate material, such as photographic paper. This "picture of an ornamental frame" can be glued to a more rigid member such as paperboard, corrugated board, wood, compressed cellulosic and/or polymeric materials, foam core board or the like that has been cut to size. When a beveled frame appearance is desired as in the case of this embodiment, corner cuts are made and resulting flaps are assembled in miter board fashion in order to provide a full three-dimensional production of an ornamental frame design that was the subject of the digital photograph.

Alternatively, the decorative component can be produced, such as by printing a photographic image directly onto a relatively rigid member. This is illustrated by decorative component 16*a* of the embodiment illustrated in FIGS. 7 through 9.

In embodiments that have beveled frame face features, such as FIGS. 1-4, in addition to the frame face substrate 15 which provides a projecting three-dimensional aspect of the device, an interior perimeter non-projecting frame component 25 can be provided. This combination of the projecting frame face substrate and the non-projecting perimeter frame component provides an added aesthetic appeal. It will be appreciated that, with this approach, the print or other item to be displayed 18 abuts the interior perimeter frame component 25, and the projecting frame face such as substrate 15 presents a concave, three-dimensional projection or flap. This includes four joints 26 that mimic a traditional frame. The decorative component 16 can display varying metallic colors such as gilt, gold, silver and brass. These can have the appearance of painted metallic colors. Other decorative elements and/or indicia can be provided in virtually any color or shape. In especially effective embodiments, the overall impression will "fool the eye" with its aesthetic appeal.

For purposes of discussion, the decorative component 16, 16*a* is referred to at times herein as being the decorative component that provides a gold frame. It will of course be appreciated that the decorative component can be in any ornamental design, color or the like. The illustrated gold frame is classical in appearance, attractive, inexpensive, and reusable. Other decorative components may include graphics that can have an element of incompleteness so that the user can add further decoration elements such as coloration, completion, and/or additive members such as stickers. It may be used to adorn children's art, photos, poster prints, flat board canvas, and stretched canvas (stretched canvas with an adaptor kit); it can be used as a temporary frame until a permanent frame is purchased.

In an important advantage of this invention, the frame assembly can be provided on a mass-market scale at a relatively low cost. Illustrated embodiments are intended to accommodate the most popular poster and print sizes found in the marketplace, for example: 8 inches×10 inches, 10 inches×11 inches, 20 inches×24 inches, etc. A fold-out-foot 17 of the backboard is illustrated as a mechanism for supporting the frame assembly on a horizontal surface. A typical foot 17 in this regard can range from about 3 inches to about 6 inches or greater for aesthetic impact and function.

Figures 2, 3, 4, 5, 6:
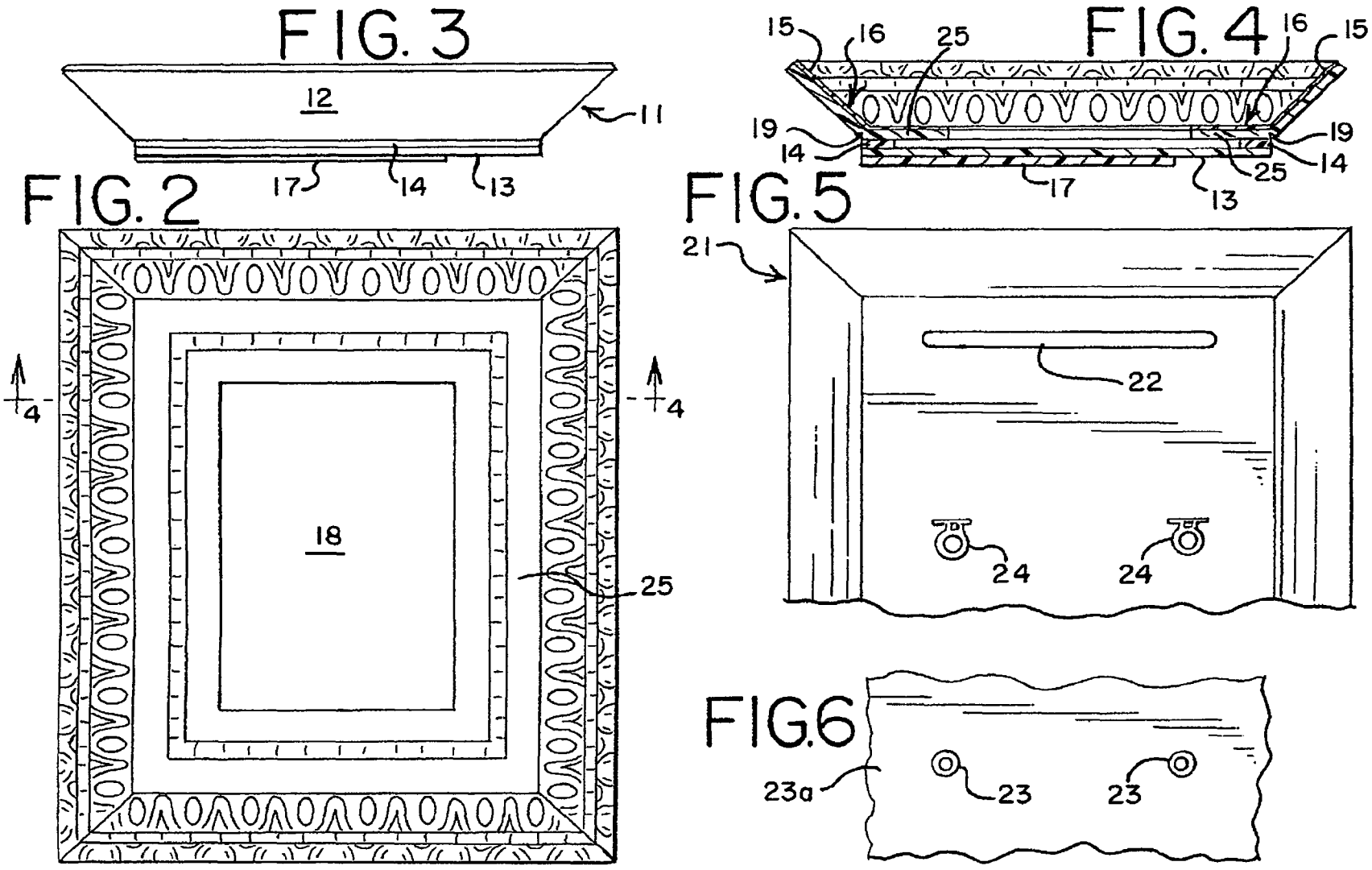
FIG. 2 is a front plan view of a frame assembly as illustrated in FIG. 1.
FIG. 3 is a top elevational view of the illustrated frame assembly.
FIG. 4 is a cross-sectional view along the line 4-4 of FIG. 2.
FIG. 5 is a rear plan view of another frame assembly.
FIG. 6 is an elevational view of suspension members suitable for use with the frame assembly of FIG. 5.

FIGS. 5 and 6 illustrate hanging approaches including magnetic ones. This frame assembly 21 has a magnetic strip 22 (which can be shaped as desired and varied as noted herein). Correspondingly, one or more disks 23 (FIG. 6) are positioned on a surface, typically a vertical surface 23*a*. Alternatively, one or more grommets 24 can be secured to the backboard or the like to facilitate support or hanging, such as be threading a hanger wire therethrough.

With reference to the embodiment illustrated in FIGS. 1-4, the backboard 13 helps to hold the print (shown in phantom at 18 in FIG. 1) in place. In addition to or instead of a component such as the fold-out foot 17, the backboard can include a feature to allow for wall hanging, such as a recess or a hanging member such as an eyelet.

A typical spacer 14 is of a U-shaped configuration as illustrated in FIG. 1 and has a thickness adequate to accommodate a typical print or other item to be displayed 18. A typical thickness for the spacer 14 is one-eighth inch. This allows the print or the like item to be displayed to readily slide in and out through the space that is provided between the opposing legs of the spacer 14.

Referring generally to the method of assembly of an embodiment such as shown in FIG. 1, and in keeping with the reference to a gold frame, the process typically can include taking a digital picture of an ornate gold or frame made of wood, metal, polymer, plaster or other rigid material. A properly sized print then can be prepared therefrom. This then is glued or otherwise secured to foam core board or other substrate more rigid than a typical photo print paper. The board is cut specifically to accommodate the item to be displayed such as the print, picture or the like. The item to be displayed can be of a known dimensional size, although custom manufacture also is contemplated when needed.

During the cutting of the relatively rigid substrate, the outer edge is cut to conform to the sizing of the decorative component 16 or "picture of the frame" in an illustrated embodiment. In this type of style, the corners are mitered. Depending upon the frame style, the mitering typically will be between about 25° and 35° at miter location 27. Typically, the center will be cut to the desired sizing, often commensurate with the most popular sizes needed for mass marketing. The miter location can include interacting members on opposing miter corner edges, illustrated in other embodiments herein.

Continuing with the method of assembly, on the reverse side of the decorative component of the frame, lines are scored, such as at score line 19 (FIG. 4). Four lines are scored on the reverse side to create lines of weakness for easy folding of the flaps toward the front side of the perimeter face member in this embodiment. The four line sizes are commensurate to the size of the frame. The four lines are scored between about 2 inches and about 6 inches from the above center cut to maintain the ornamental two-dimensional section of the "picture of the frame" having a three-dimensional appearance in this type of embodiment. This also is where the item 18 to be displayed abuts the frame.

Next, the flaps are folded from the scored lines and the corners joined. Mitered corners are joined at the seams using strong adhesive, gold decorative stickers, tape including clear tape, tabs, dove-tailing, or other suitable means. In this example, as shown in FIG. 1, the projecting perimeter face member 12 and the non-projecting interior perimeter member 25 are adorned with the decorative component.

Thereafter, the backboard is fitted over the back side of the frame, but not the flaps of the perimeter frame member 12. The spacer 14 of this embodiment is secured to the backboard and to the frame by suitable means, such as glue. A typical spacer has a width of about one-eighth inch to about one-half inch, typically being made of the same type of substantially rigid material as the rest of the unit, such as foam core board or corrugated board for example.

With further reference to materials of construction, foam core board has been found to be an excellent assembly material. Of course, other materials can be used, provided they impart adequate strength and minimal weight to the frame assembly. Materials of a paperboard type can be used, as can other cellulosic materials, including light woods or composites. Polymer materials besides those included in foam core board also can be used. Combinations of materials also can be suitable, including combinations of natural and synthetic materials. An important consideration is cost, with less expensive materials being preferred.

A typical backboard 13 will be made of paperboard materials that often are customarily employed in picture frames. Other materials such as those noted above also could be used. Once again, cost considerations will be important in selecting materials and design details for the backboard of the frame assembly.

Another embodiment of a frame arrangement is a frame assembly 31 that incorporates a door-like assembly for facilitating placement of the item to be displayed 18. Generally, by this approach, illustrated in FIGS. 7, 8 and 9, the backboard, generally shown at 33, is secured to the perimeter frame member 32 by any of a variety of approaches such as the illustrated tape strips 30. The backboard has a hinged door 34 that opens to insert or remove the item 18 and closes to secure the item in place. Flaps or perimeter frame members 32 are shown in the front component of this embodiment, in FIG. 7, in a fashion by which they mate at joints 36. Folds and/or score lines 39 (FIG. 8) typically will facilitate bending to form the perimeter frame. Matting 37 can be included to lay against and accent the item to be displayed 18. A window opening 38 is present and can generally coincide with the perimeter of the matting 37.

Figure 7:
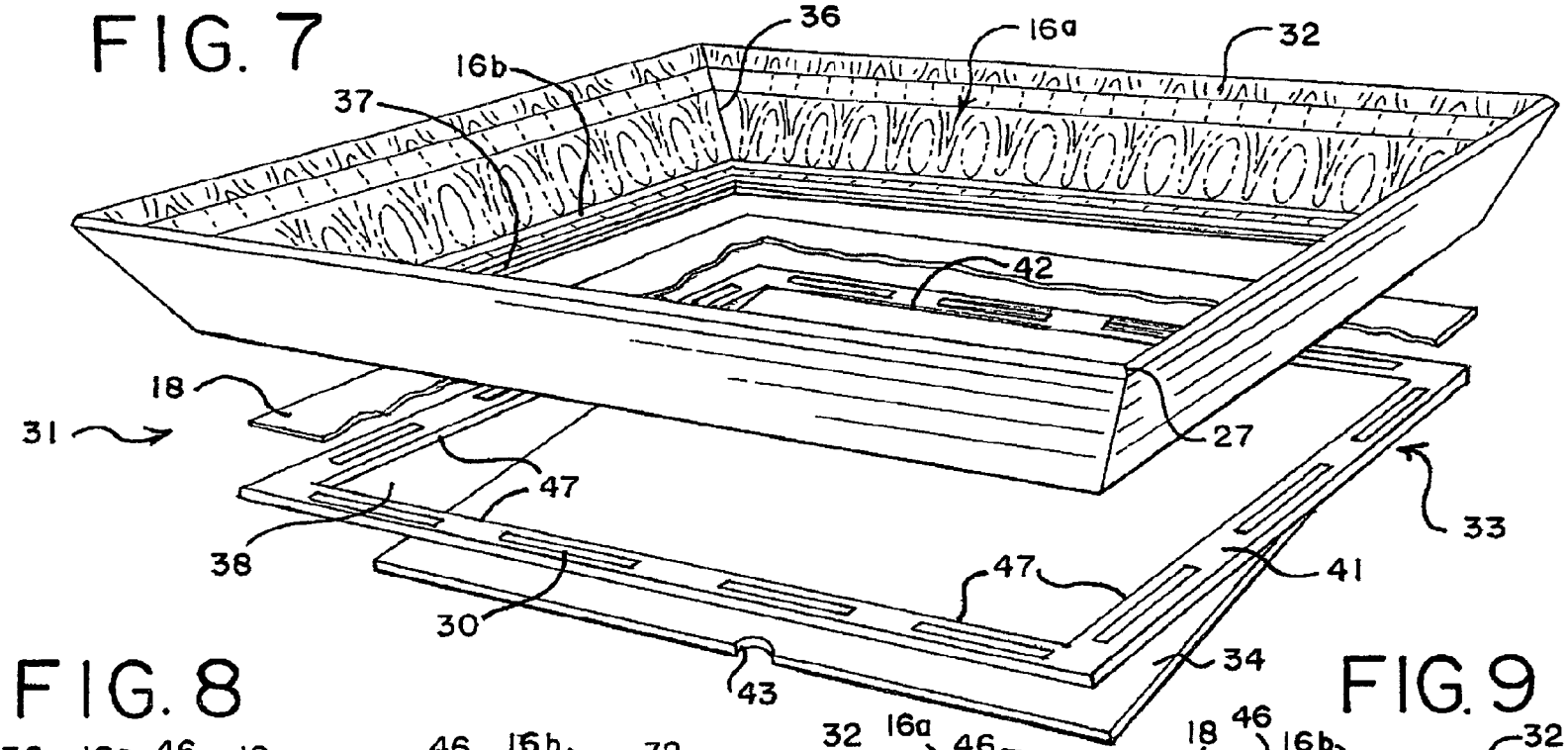
FIG. 7 is an exploded perspective view of another illustrative embodiment of a decorative frame assembly.

FIG. 7 illustrates the backboard 33 having hinged door 34 and a frame 41 joined by a hinge 42. Hinge 42 can be secured by suitable means, or it can be formed as scored flute board with no through cut away line. To facilitate opening of the door 34, a cut-out 43 can be included to provide a finger pull feature. The rear face 44 of the backboard can have a keyhole on each of two sides to allow for simple hanging action in one of two orientations.

Figure 9:
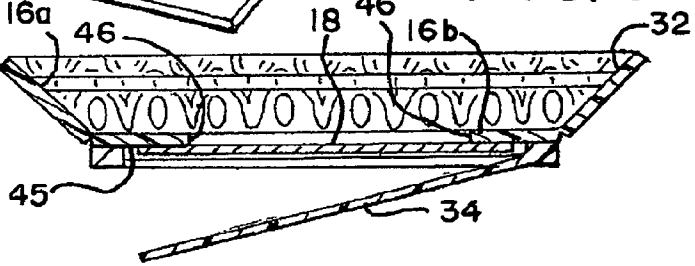
FIG. 9 is a transverse cross-sectional view along the width of the frame assembly as in FIG. 8.
Figure 8:
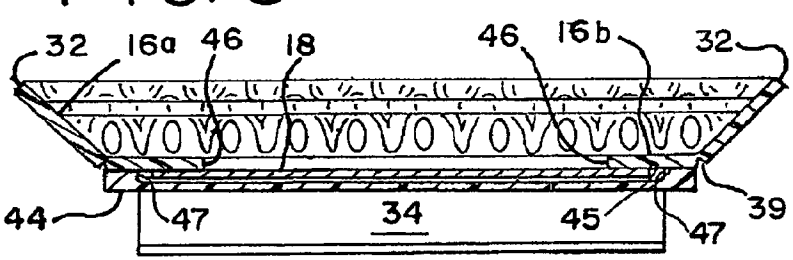
FIG. 8 is a transverse cross-sectional view along the length of the frame assembly of FIG. 7, after assembly with a display item shown therein.
Figure 10:
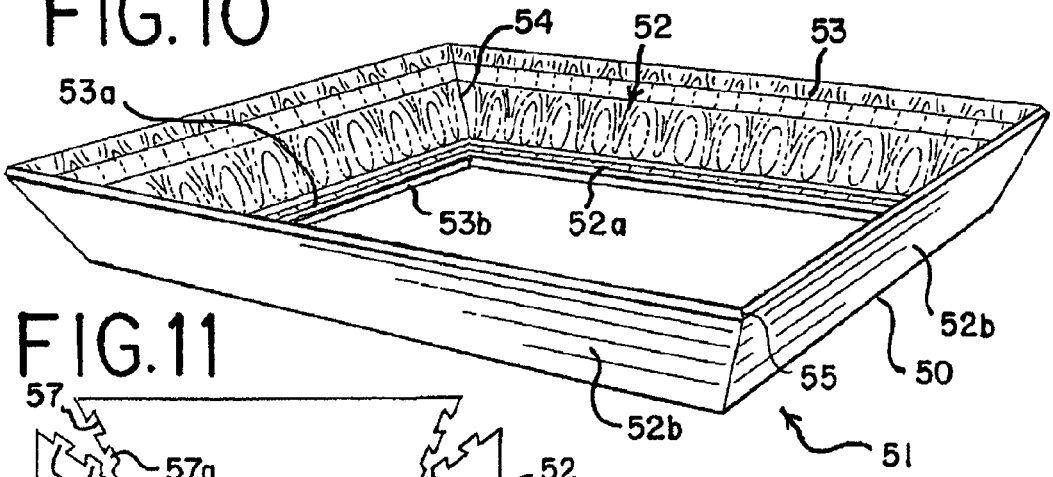
FIG. 10 is a perspective view of a further embodiment of a decorative frame assembly.

In FIGS. 8 and 9, cross-sectional views normal to each other show the front component and backboard assembled together. The door 34 is shown open, revealing a lip 45. It will be understood that the item to be displayed 18 can be positioned over the lip 45 (indicia side of the item 18 being to the front or into the plane of FIG. 7 as thus displayed). After the door 34 is closed, the perimeter of item 18 is sandwiched between the perimeter of the door 34 and the lip 45. The inside perimeter 46 of the lip 45 is less than the opening perimeter 47 of the door 34 to create the lip. Decorative components 16*a* and 16*b* surround item 18.

Figure 11:
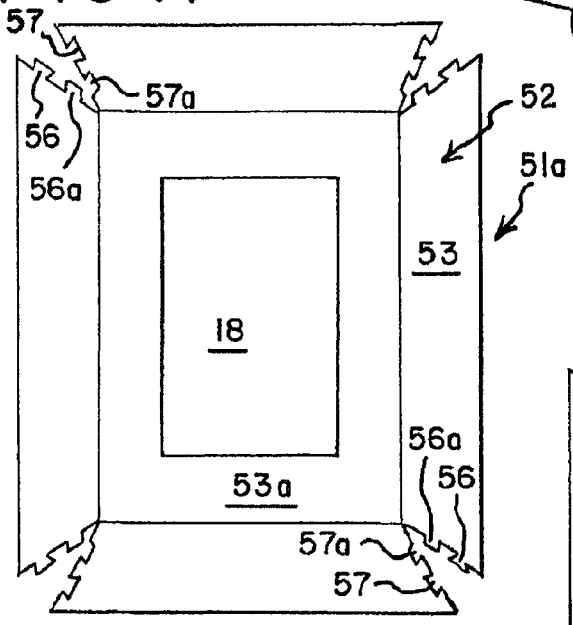
FIG. 11 is a front elevational view of the FIG. 10 embodiment, modified into a further embodiment, prior to joining of the four corners thereof.
Figure 10A:
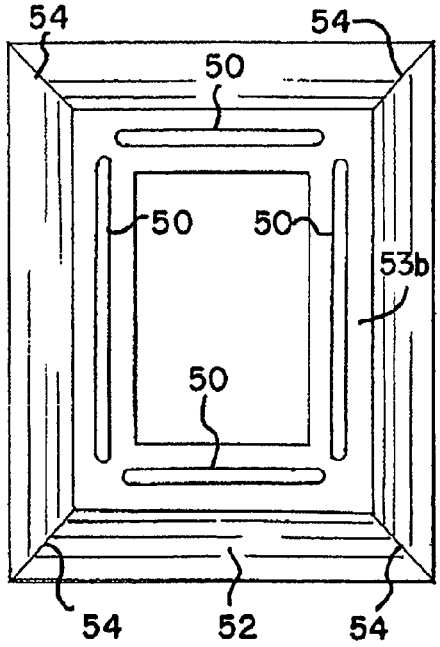
FIG. 10A is a bottom plan view of the embodiment of FIG. 10.
Figure 12:
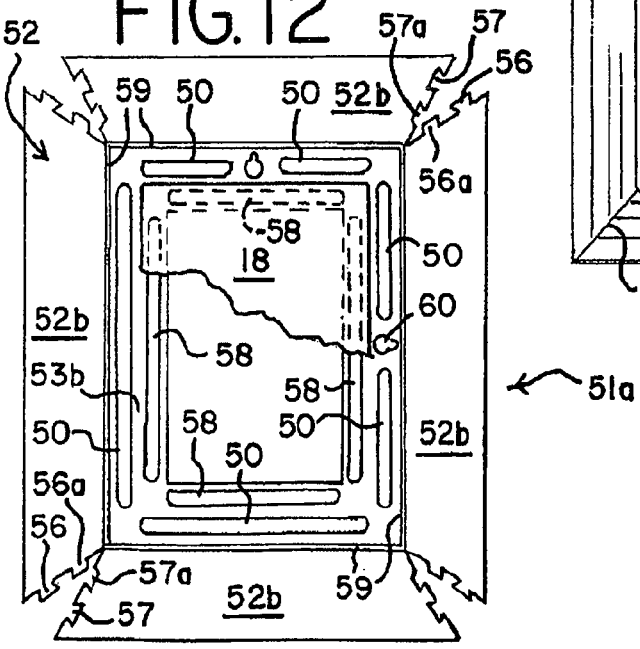
FIG. 12 is a rear elevational view, partially broken away, of the frame assembly as in FIG. 11.

FIGS. 10, 10A, 11 and 12 illustrate "façade" types of arrangements for a frame assembly. With frame assembly 51 and 51*a* decorative component 53 is provided, and same can cover perimeter frame member 52. Decorative component 53*a* can be included on the illustrated front surface of flat frame member 52*a*, whether a continuation of frame member 52 and decorative component 53 or as separate features. Typically, rear face 52*b* of the perimeter frame member 52 is unadorned, but same can be adorned if desired. Joint 54 and miter location 55 are illustrated in FIGS. 11 and 12 with tabs or detents 56, 56*a* and generally complementary slots or indents 57, 57*a*. Each can have a similar overall outline shape or can be different such as shown in FIGS. 11 and 12. In the arrangement illustrated in FIGS. 10 and 10*a*, an adhesive member 50, which can be for example double-sided tape, is positioned on the non-decorative portions of the frame assembly 51. In the illustrated arrangement, a plurality of adhesive members 50 are positioned on the back surface 53*b* of the of the flat frame member 52*a*. The user then adheres the frame assembly 51 onto the face of an existing traditional frame. In this way, what might be a drab or unattractive frame is transformed into a frame exhibiting the decorative component present on this façade-type of frame assembly.

In the arrangement illustrated in FIGS. 11 and 12, the item to be displayed 18 is secured directly to the frame assembly 51 by adhesive strips 58 such as double-sided tape. Score line 59 can be provided to facilitate bending. A recessed keyhole 60 is shown for supporting the product at one of two orientations. If desired, the adhesive member or members 50 also can be included in this particular embodiment, as illustrated in FIG. 12.

Figure 13:
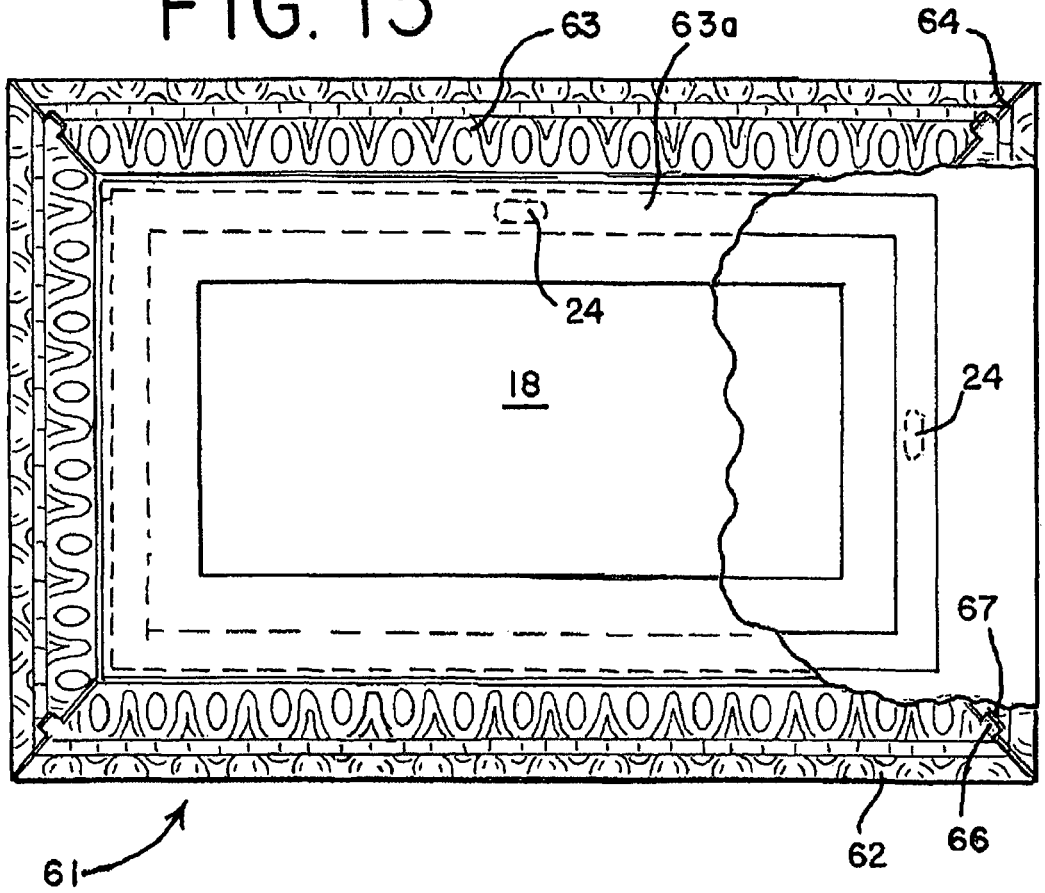
FIG. 13 is a front elevational view, partially broken away, of an additional embodiment of a decorative frame assembly.
Figure 14:
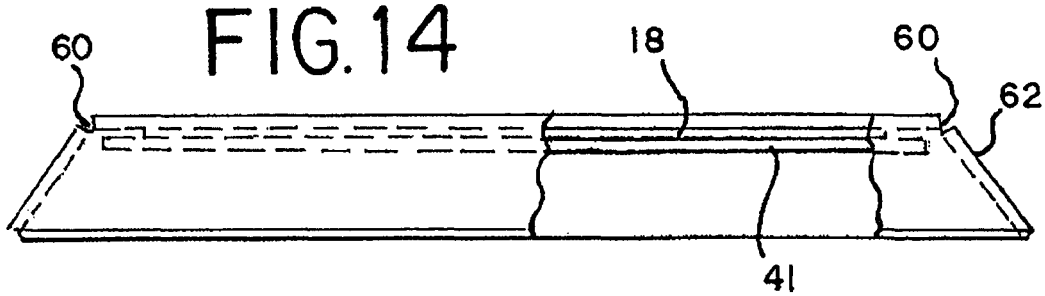
FIG. 14 is a longitudinal side elevational view, partially broken away, of the FIG. 13 embodiment.
Figure 15:
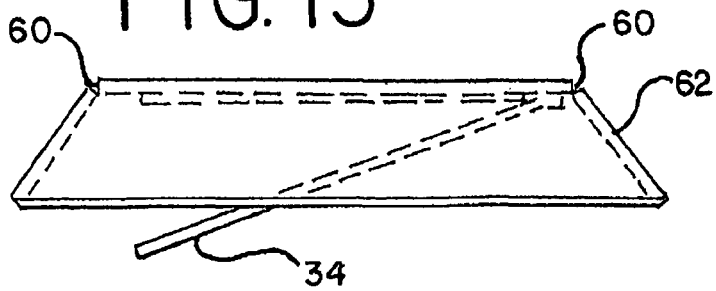
FIG. 15 is a transverse side elevational view of the FIG. 13 embodiment.

It will be seen from the embodiment of FIGS. 13, 14 and 15 that a frame assembly 61 can have a perimeter frame member 62 that projects generally rearwardly if desired by bending the parts of the frame member in this direction to give a different effect from bending generally forwardly. This can be referred to as a "shadow box" effect. Score lines 60 can be provided.

Decorative component is found on one or both of the beveled or flat faces, at 63 and 63*a* respectively. Backboard with door and grommets as in other embodiments also are shown. Joint 64 can include a tab or detent 66 and a corresponding slot or indent 67 at each miter corner.

Figures 16, 17:
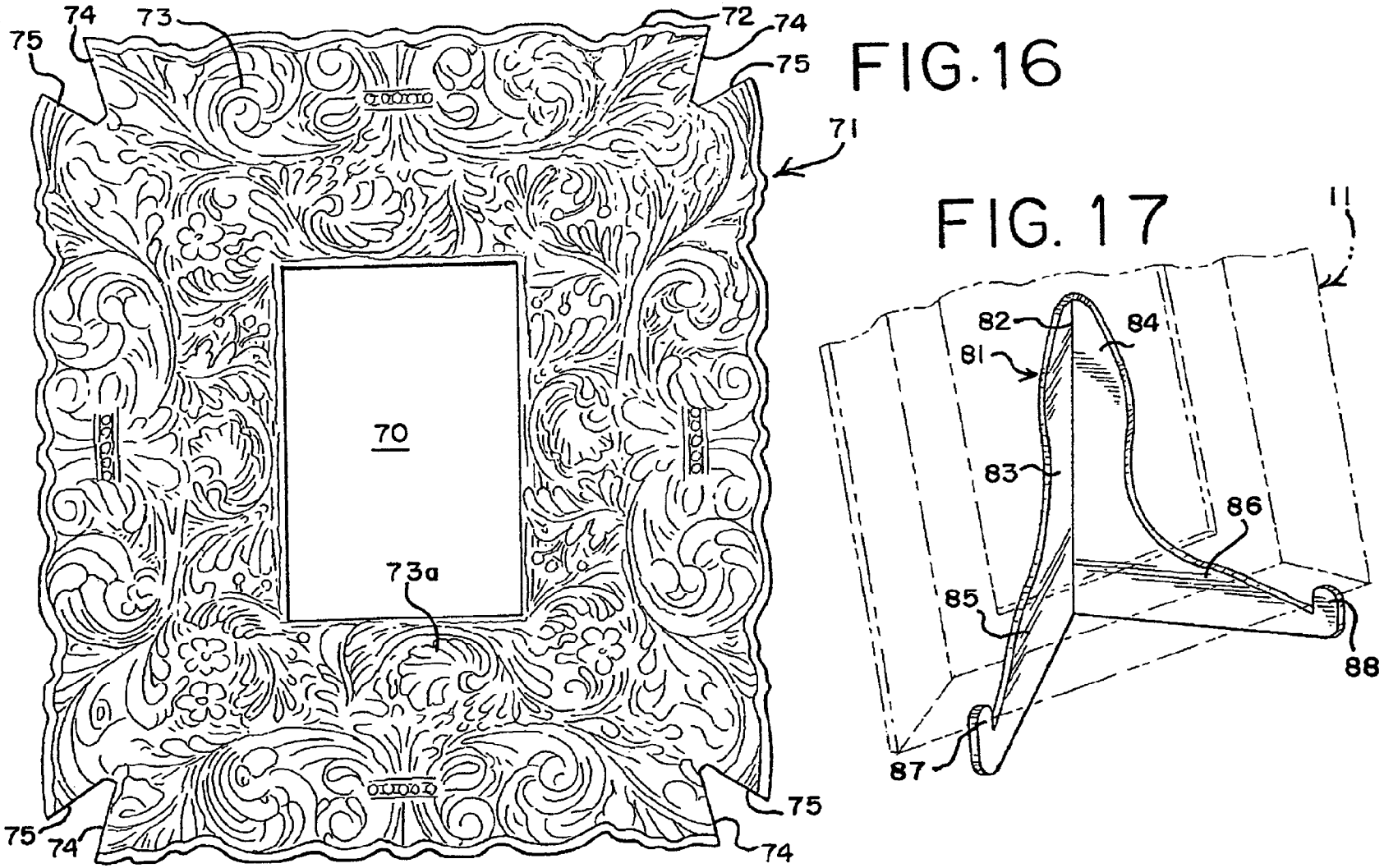
FIG. 16 is a plan view of an embodiment of a decorative frame assembly illustrating an example of a decoration motif in some detail.
FIG. 17 is a perspective view of an illustration of an alternative support member for frame assemblies according to illustrated embodiments.

FIG. 16 shows a frame component 71 that illustrates the type of ornamental detail that can be provided by the present approach. Here perimeter frame member 72 has a portion 73 to form an angled surface and a portion 73*a* to provide a flat surface in close proximity to an item for display that will be visible through window or enclosed area 70. Joints are formed by moving beveled edge 74 into contact or close proximity with beveled edge 75 at each corner.

FIG. 17 illustrates an alternative approach for supporting a frame assembly, shown in phantom and generally illustrated at 11. An easel member, generally designated 81, is provided. Same includes a bend location 82, back support portions 83 and 84, extending portions 85 and 86, and projecting ends 87 and 88 for supporting the frame assembly.

Figure 18:
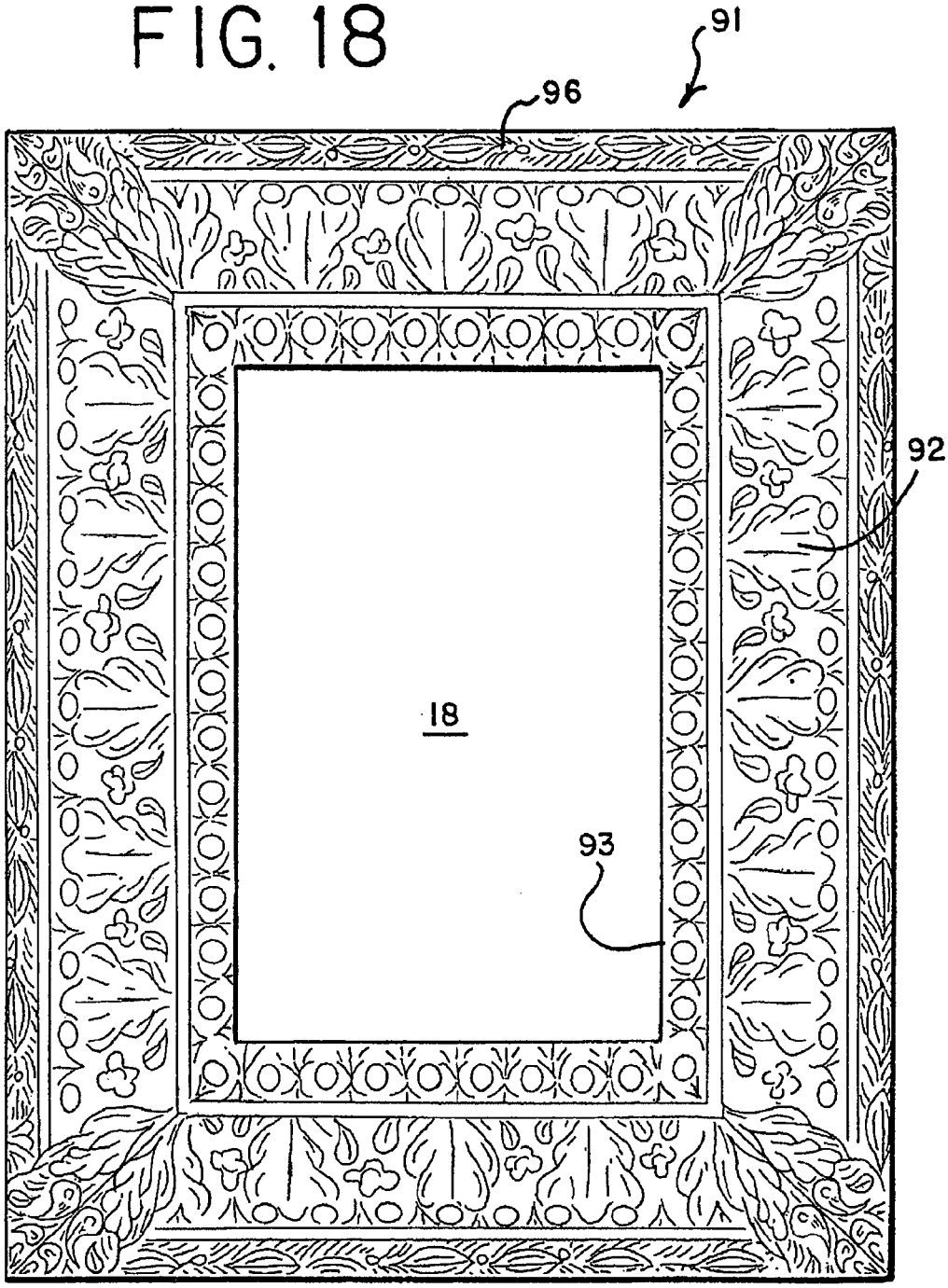
FIG. 18 is a front elevational view of another embodiment of a frame assembly.
Figure 19:
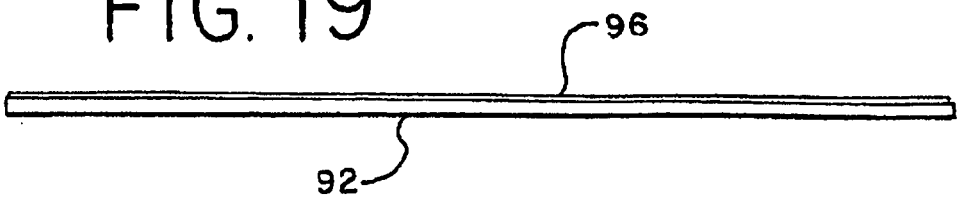
FIG. 19 is a top plan view of the embodiment of FIG. 18.

FIGS. 18 and 19 depict a frame assembly 91 that comprises a perimeter frame portion 92 with an opening 93 for surrounding an item to be displayed 18. In this embodiment a decorative component sheet 96 is secured to the perimeter frame portion by suitable means including approaches discussed herein. Mounting the item to be displayed 18 can be carried out as desired. Examples in this regard include adhesive strips on the rear face of the perimeter frame portion, providing a backboard as noted herein, or other approaches.

The backboard 13 illustrated in FIG. 1 includes a fold-out foot 17 that functions to hold the device in an upright or display mode. When desired, such a foot 17 is arranged so that the frame can be oriented in either an "upright" or portrait position or an "on-the-side" or landscape position. The same is possible for other mounting approaches.

Of the possible mounting approaches, FIGS. 5 and 6 show a frame assembly, generally designated at 21, that includes a magnetic-type arrangement for suspending the frame assembly from a vertical wall. Included is a strip 22 which preferably is a ferromagnetic metal or other material that will be responsive to and thus provide magnetic engagement with a magnetized component, that is a component that provides a magnetic field. In this illustrated embodiment, a pair of disks 23 are provided. Each disk is secured to a wall or other vertical surface, such as by a pin, nail, brad, tape or adhesive. Once the disks are secured onto the desired vertical surface, the frame assembly 21 is positioned against the vertical surface so that one or more strip 22, disk 23 or plate of the vertical surface engage the opposing member of the frame thereby hanging the frame assembly "magnetically". In some embodiments having a magnetic approach, each of one or more magnetic strip 22 or magnetic disc 23, magnetic plate or the like that provide a magnetic field is secured to the backboard by suitable assembly means such as those mentioned herein. Then, mount receptor surfaces are used that are responsive to the magnetic field of the strip 22, disc 23, plate or the like so as to be attracted thereto and held thereby.

In other embodiments having a magnetic approach for hanging, the member providing the magnetic field is located on the wall or other mounting surface. Same can be nailed, pinned, screwed, glued or otherwise secured to the wall or the like. Correspondingly, the member responsive to the magnetic field, in the form of a strip, disc, plate or the like, is positioned on a rear portion of the frame device. Whichever approach is used when magnetic mounting is practiced, the sizing and magnetic field strength are chosen to be adequate so that the frame and its item to be displayed are maintained to be supported or "hung" from the wall or other surface to be ornamented.

It will be understood that the embodiments of the present invention which have been described are illustrative of some of the applications of the principles of the present invention. Numerous modifications may be made by those skilled in the art without departing from the true spirit and scope of the invention. Various features which are described herein can be used in any combination and are not limited to procure combinations that are specifically outlined herein.

The invention claimed is:

1. A decorative frame assembly comprising:

a perimeter frame member having a plurality of corners and an outwardly facing frame face substrate, such outwardly facing substrate having a decorative component that provides decorative aspects to the frame assembly, wherein said decorative component had been generated by direct reproduction from an original having chosen appearance characteristics, the decorative component exclusively being a photograph of a preexisting decorative picture frame;

said perimeter frame member having a non-projecting state at which the entire perimeter frame member lies along a common plane, and corner cuts define a pair of opposing flaps, each flap being foldable along a line of the perimeter frame member, the pair of flaps being at each said corner and defining a gap between each pair of flaps, said perimeter frame member also having a projecting frame state;

said perimeter frame member has a flat frame member projecting inwardly with respect to the frame member and remaining flat at the projecting frame state, the flat frame member having a front face, and said decorative component photograph of the preexisting picture frame extends over said flat frame member front face as well as said perimeter frame member at the projecting frame state;

a backboard member having a central area adapted to receive an item to be displayed within the frame assembly, said backboard member further including a display facilitating element;

said perimeter frame member includes an enclosed area through which the item to be displayed is visible when the backboard and perimeter frame member are joined together and the item to be displayed is located therebetween; and said perimeter frame member has a miter location at each said corner, each miter location is a mitered assembly of said pair of opposing flaps of the perimeter frame member, each said gap is filled by said pair of flaps and said flaps engage each other when said perimeter is at said projecting frame state to define the mitered assembly, thereby providing a three-dimensional appearance whereby the pair of opposing flaps project outwardly relative to said common plane;

whereby a decorative frame assembly is provided that mimics a preexisting decorative picture frame.

2. The frame assembly in accordance with claim 1, further including a spacer component positioned between the perimeter frame member and the backboard member, said spacer facilitating entry of an item to be displayed into the frame assembly.

3. The frame assembly in accordance with claim 1, wherein said decorative component is printed onto a substrate and said substrate is secured to the perimeter frame member.

4. The frame assembly in accordance with claim 1, wherein said decorative component is printed directly onto the perimeter frame member.

5. The frame assembly in accordance with claim 1, wherein said pair of opposing flaps have complementary members that engage each other to facilitate assembly of the flaps together into the mitered assembly.

6. The frame assembly in accordance with claim 5, wherein one of said complementary members is a detent and the other complementary member is an intent.

7. The frame assembly in accordance with claim 1, further including a display facilitating element that is selected from a fold-out foot, a grommet, a keyhole, or a magnetic member.

8. The frame assembly in accordance with claim 7, wherein said display facilitating element is a magnetic member that imports a magnetic field and that is on an outside surface of the backboard, wherein said magnetic member is adapted to exhibit magnetic attraction between same and a magnetically responsive member of a surface from which the frame assembly is to be mounted.

9. The frame assembly in accordance with claim 1, wherein said backboard includes a door to provide access to the enclosed area of the perimeter frame member.

10. A decorative frame assembly comprising:

a perimeter frame member having a plurality of corners and an outwardly facing frame face substrate, such outwardly facing substrate having a decorative component that provides decorative aspects to the frame assembly, wherein said decorative component had been generated by direct reproduction onto said outwardly facing frame face substrate from an original having chosen appearance characteristics, the decorative component exclusively being a photograph of a preexisting decorative picture frame;

said perimeter frame member having a non-projecting state at which the entire perimeter frame member lies along a common plane, and corner cuts define a pair of opposing flaps, each flap being foldable along a line of the perimeter frame member, the pair of flaps being at each said corner and defining a gap between each pair of flaps, said perimeter frame member also having a projecting frame state;

said perimeter frame member has a flat frame member projecting inwardly with respect to the frame member and remaining flat at the projecting frame state, the flat frame member having a front face, and said decorative component photograph of the preexisting picture frame extends over said flat frame member front face as well as said perimeter frame member at the projecting frame state;

said perimeter frame member has a miter location at each said corner, each miter location is a mitered assembly of said pair of opposing flaps of the perimeter frame member, each said gap is filled by said pair of flaps and said flaps engage each other when said perimeter is at said projecting frame state to define the mitered assembly, thereby providing a three-dimensional appearance whereby the pair of opposing flaps project outwardly relative to said common plane; and said perimeter frame member includes an enclosed area through which the item to be displayed is visible when the item to be displayed is located therebetween;

whereby a decorative frame assembly is provided that mimics a preexisting decorative picture frame.

11. The assembly in accordance with claim 10, wherein said decorative component is printed onto a substrate and said substrate is secured to the perimeter frame member.

12. The assembly in accordance with claim 10, wherein each said pair of opposing flaps have complementary members that engage each other to facilitate assembly of the flaps together into the mitered assembly.

13. The assembly in accordance with claim 10, wherein said flat frame member has a rear face, and said rear face includes at least one adhesive member adapted to adhere the decorative frame assembly onto a separate frame.

14. The assembly in accordance with claim 10, wherein said flat frame member has a rear face, and said rear face includes at least one adhesive strip adapted to adhere the item to be displayed to said flat frame member rear face whereby the item to be displayed is visible through said enclosed area.

15. The assembly in accordance with claim 13, wherein said rear face of the flat frame member includes at least one adhesive strip adapted to adhere the item to be displayed on said flat frame member rear face whereby the item to be displayed is visible through said enclosed area.

16. A decorative frame comprising a perimeter frame member having a plurality of corners and an outwardly facing frame face substrate, such outwardly facing substrate having a decorative component that provides decorative aspects to the frame assembly, wherein said decorative component had been generated by direct reproduction from an original having chosen appearance characteristics;

said perimeter frame member having a non-projecting state at which the entire perimeter frame member lies along a common plane, and corner cuts define a pair of opposing flaps, each flap being foldable along a line of the perimeter frame member, the pair of flaps being at each said corner and defining a gap between each pair of flaps, said perimeter frame member also having a projecting frame state;

said perimeter frame member includes an enclosed area through which the item to be displayed is visible when the backboard and perimeter frame member are joined together and the item to be displayed is located therebetween;

said decorative component exclusively is a photograph of a preexisting decorative picture frame printed directly onto a substrate and said substrate is secured to the perimeter frame member; and said perimeter frame member has a flat frame member projecting inwardly with respect to the frame member and remaining flat at the projecting frame state, the flat frame member having a front face, and said decorative component photograph of the preexisting picture frame extends over said flat frame member front face as well as said perimeter frame member at the projecting frame state;

said perimeter frame member has a miter location at each said corner, each miter location is a mitered assembly of said pair of opposing flaps of the perimeter frame member, each said gap is filled by said pair of flaps and said flaps engage each other when said perimeter is at said projecting frame to define the mitered assembly, thereby providing a three-dimensional appearance whereby the pair of opposing flaps project outwardly relative to said common plane;

whereby a decorative frame assembly is provided that mimics a preexisting decorative picture frame.

17. The assembly in accordance with claim 16, wherein said flat frame member has a rear face, and said rear face includes at least one adhesive member adapted to adhere the decorative frame assembly onto a separate frame.

18. The assembly in accordance with claim 16, wherein said flat frame member has a rear face, and said rear face includes at least one adhesive strip adapted to adhere the item to be displayed to said flat frame member rear face whereby the item to be displayed is visible through said enclosed area.

19. A method for preparing a frame assembly that mimics a preexisting decorative picture frame, comprising:

photographing a preexisting decorative picture frame as a decorative component frame element;

providing a perimeter frame member at a non-projecting state, the perimeter frame member having a flat frame member with a front face, the perimeter frame member having corners and a miter location at each corner, each miter location having a pair of opposing flaps that are spaced apart to define a gap therebetween, the flaps and gaps being in a common plane when the perimeter frame member is at said non-projecting state;

affixing the picture frame photograph to an outwardly facing surface and to the flat frame member front face of the perimeter frame member having an enclosed area through which an item to be displayed is visible when positioned behind the perimeter frame member;

securing an engagement member to the back of the perimeter frame member to provide positioning support to an item to be displayed through the enclosed area;

changing the perimeter frame member from the non-projecting state to a projecting frame state by folding each flap along a line of the perimeter frame member and thereby forming mitered assemblies on the perimeter frame member by moving each pair of flaps into engagement with each other to fill said gaps and thereby provide a three-dimensional appearance whereby the pair of opposing flaps project outwardly relative to said common plane; and assembling together the thus engaged pair of angled surfaces to thereby provide a frame assembly that mimics a preexisting decorative picture frame.

20. The method in accordance with claim 19, wherein the engagement member is a backboard, further including positioning a spacer between the perimeter frame member and backboard and assembling same together.

21. The method in accordance with claim 19, wherein the engagement member is an adhesive member, further including positioning the adhesive member to the rear surface of the perimeter frame member at a location closely spaced from the enclosed area.

22. A kit for securing a decorative frame assembly to a generally vertical surface, comprising:

a decorative frame assembly having a perimeter frame member having a plurality of corners and an outwardly facing frame face substrate, such outwardly facing substrate having a decorative component that is a photographic reproduction of a preexisting decorative picture frame, wherein said picture frame photograph had been generated by direct reproduction onto said outwardly facing frame face substrate;

said perimeter frame member having a non-projecting state at which the entire perimeter frame member lies along a common plane, and corner cuts define a pair of opposing flaps, each flap being foldable along a line of the perimeter frame member, the pair of flaps being at each said corner and defining a gap between each pair of flaps, said perimeter frame member also having a projecting frame state;

said perimeter frame member has a miter location at each said corner, each miter location is a mitered assembly of said pair of opposing flaps of the perimeter frame member, each said gap is filled by said pair of flaps and said flaps engage each other when said perimeter is at said projecting frame state to define the mitered assembly, thereby providing a three-dimensional appearance whereby the pair of opposing flaps project outwardly relative to said common plane;

said perimeter frame member includes an enclosed area through which the item to be displayed is visible when the item to be displayed is located therebetween;

whereby a decorative frame assembly is provided that mimics a preexisting decorative picture frame;

a magnetic member having magnetic field generating attributes and a receptive member having magnetic field receiving characteristics, whereby the receptive member attaches to the magnetic member by virtue of magnetic field interaction;

one of said magnetic member or said receptive member is secured to the back surface of the decorative frame assembly; and the other of said receptive member or magnetic member is secured to a generally vertical surface apart from the picture frame.

* * * * *